US006158626A

United States Patent [19]

Guerra et al.

[11] Patent Number: 6,158,626

[45] Date of Patent: Dec. 12, 2000

[54] BEVERAGE DISPENSER STANCHION COVER

[76] Inventors: Jack A. Guerra, 53334 Abraham, Macomb Township, Mich. 48042; John R. Testori, 74 Belle Meade, Grosse Pointe Shores; James J. Testori, 657 Pear Tree La., Grosse Pointe Woods, both of Mich. 48236; Richard J. Spray, 7270 Spring Water Ridge, St. Louis, Mo. 63129

[21] Appl. No.: 09/289,444

[22] Filed: Apr. 9, 1999

[51] Int. Cl.[7] ..... B67D 5/06

[52] U.S. Cl. ..... 222/183; D7/313; D7/397; 137/377

[58] Field of Search ..... 222/183, 131; D7/313, 397, 398; 137/377, 382

[56] References Cited

U.S. PATENT DOCUMENTS

| | | | |
|---|---|---|---|
| D. 304,665 | 11/1989 | Start . | |
| D. 311,299 | 10/1990 | Start . | |
| D. 311,841 | 11/1990 | Start . | |
| D. 315,078 | 3/1991 | Nikolaiczyk et al. | D7/397 |
| D. 325,491 | 4/1992 | Nikolaiczyk et al. | D7/313 |
| D. 331,683 | 12/1992 | Koester | D7/397 |
| 2,262,043 | 11/1941 | Perlick . | |
| 2,316,406 | 4/1943 | Cornelius . | |
| 2,331,729 | 10/1943 | Rice . | |
| 3,752,192 | 8/1973 | Kleppin . | |
| 5,232,129 | 8/1993 | Guerra . | |

FOREIGN PATENT DOCUMENTS

| | | |
|---|---|---|
| 2095890 | 11/1993 | Canada . |

*Primary Examiner*—Philippe Derakshani
*Attorney, Agent, or Firm*—Young & Basile, P.C.

[57] ABSTRACT

A cover for a beverage dispenser stanchion, such as a draft beer tower or the like, having a front containing a tap and a back substantially distal to the tap. The cover comprises a housing shaped to contain at least the stanchion back. The housing comprises a body having a top region, a bottom and a longitudinal opening extending substantially from the body top region to the body bottom, the opening for receiving the stanchion, and adapted to have at least the stanchion front extending outwardly therefrom, the opening further adapted to have the tap extending outwardly and operatively therefrom. A mechanism is provided for quickly and removably mounting the housing to the stanchion.

16 Claims, 2 Drawing Sheets

BEVERAGE DISPENSER STANCHION COVER

BACKGROUND OF THE INVENTION

The present invention relates generally to beverage dispenser stanchion covers, and more particularly to such a cover which can quickly and easily be installed on, or removed from an existing beverage dispenser stanchion.

Most beverage dispenser stanchions are of relatively simple construction, and not aesthetically pleasing to the eye. These stanchions, such as for draft beer and the like, are generally comprised of a simple cylindrical metal member having a tap attached thereto. Many bar and/or restaurant owners would appreciate having more elegant dispenser stanchions, especially ones which could match or complement the decor of the surroundings. However, these owners are reluctant to go to the time and expense involved in purchasing and installing a dedicated decorative stanchion. This can be expensive, as well as wasteful if the decor changes, or if for any other reason the owner desired to change the stanchion. In that case, the entire dispenser stanchion would have to be removed and replaced, which can be costly and time consuming.

Some stanchion covers have been proposed in the past. However, most of these could be quite complicated to attach to and/or remove from the stanchion. Some covers also required at least partial disassembly of the stanchion in order to attach/remove the cover. Further, previously proposed covers would generally have to be completely removed from the stanchion in order to clean the stanchion and/or the cover.

Thus, it is an object of the present invention to provide a beverage dispenser stanchion cover which fits on an existing stanchion and can advantageously be quickly, simply and inexpensively installed and removed and changed at will without need for specialized labor or tools. It is a further object of the present invention to provide such a cover which advantageously provides an aesthetic view for the customer, while yet allowing the substantial cleaning of the stanchion and/or cover while the cover is attached to the stanchion and/or only partially removed. Yet further, it is an object of the present invention to provide such a cover which may be attached/removed without even partial disassembly of the stanchion.

SUMMARY OF THE INVENTION

The present invention addresses and solves the above-mentioned problems and meets the enumerated objects and advantages, as well as others not enumerated, by providing a cover for a beverage dispenser stanchion having a front containing a tap and a back substantially distal to the tap. The cover comprises a housing shaped and adapted to contain at least the stanchion back. The housing comprises a body having a top region, a bottom and a longitudinal opening extending substantially from the body top region to the body bottom, the opening adapted to receive the stanchion, and adapted to have at least the stanchion front extending outwardly therefrom, the opening further adapted to have the tap extending outwardly and operatively therefrom. Means are also provided for quickly and removably mounting the housing to the stanchion.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
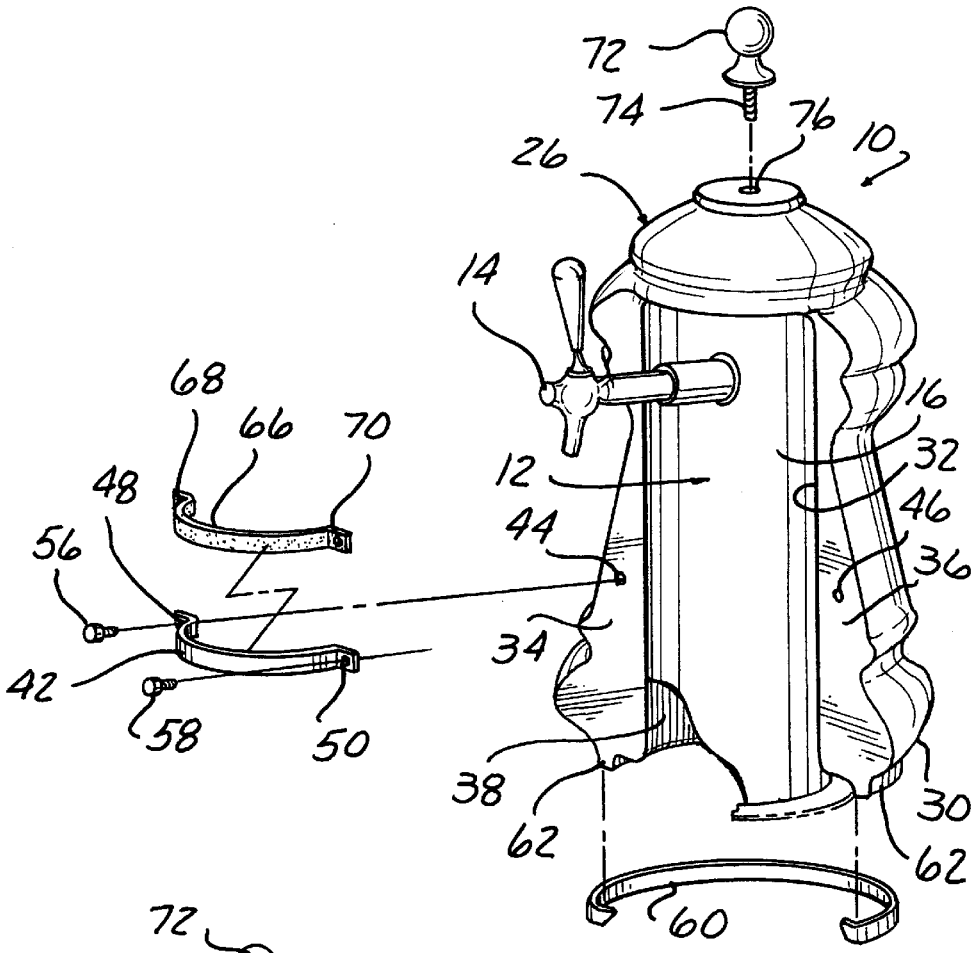
FIG. 1 is an exploded, partially cut away, perspective view of the present invention.

Referring now to FIG. 1, the cover of the present invention is designated generally as 10. Cover 10 is adapted to cover a beverage dispenser stanchion 12 having a tap 14, a front 16 containing tap 14, and a back 18 substantially distal to the tap. The stanchion 12 further has an upper region 20 above tap 14, as well as two opposed side regions 22, 24.

Cover 10 comprises a housing shaped and adapted to contain at least the stanchion back 18. The housing comprises a body 26 having a top region 28, a bottom 30 and a longitudinal opening 32 extending substantially from the body top region 28 to the body bottom 30. The opening 32 is adapted to receive the stanchion 12, and is adapted to have at least the stanchion front 16 extending outwardly therefrom. Opening 32 is further adapted to have the tap 14 extending outwardly and operatively therefrom. In the preferred embodiment, as can best be seen in FIGS. 1 and 2, the housing is shaped and adapted to contain the stanchion back 18, as well as the stanchion two opposed side regions 22, 24.

It is to be understood that cover 10 may be formed in any suitable shape, size and/or configuration, and by any manufacturing methods conventionally known in the art. It can also be formed of any suitable material, including but not limited to ceramic, wood, any and all suitable polymeric materials, metal, any other suitable material(s), and/or any combination of the above. Whatever material is used, for sanitary and/or aesthetic reasons, it should be resistant to deterioration from moisture (at least at or adjacent any surfaces which may come in direct contact with beverage), and/or be coated with a material to promote moisture resistance. In the preferred embodiment, the cover 10 material is a combination of ceramic (body 26) and metal (bracket 42, handle 72, screws 56, 58, and stand off 60).

It is to be understood that the tap 14 may be disposed in any suitable area of longitudinal opening 32; however, in the preferred embodiment, tap 14 is disposed approximately adjacent the body top region 28.

In the preferred embodiment, the body 26 is an integrally formed, one-piece member. However, it is to be understood that it is contemplated as being within the purview of this invention, and is an alternate preferred embodiment, that body 26 be formed from at least two or more sections/pieces.

Figure 4:
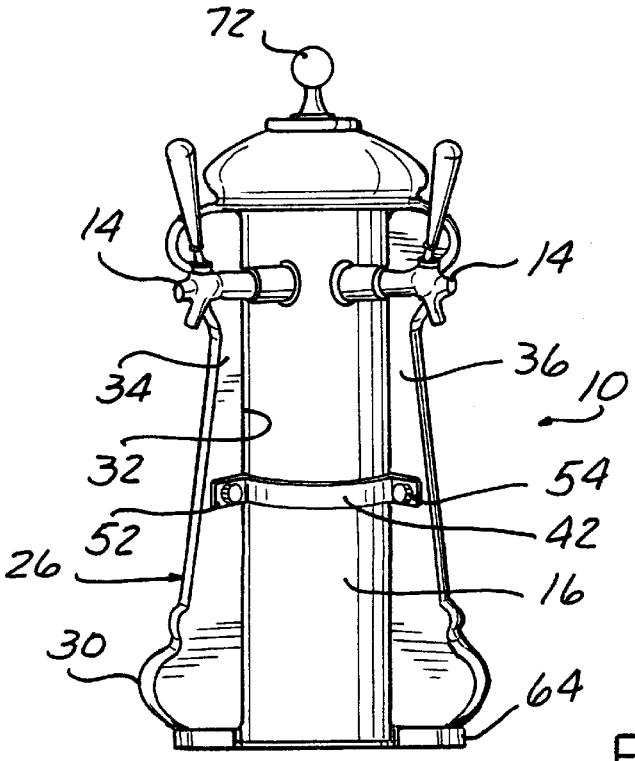
FIG. 4 is a front view of the present invention shown in place on a dual-tap beverage dispenser stanchion.

As can be seen in FIGS. 1 and 4, opening 32 has two opposed sides. Body 26 may further comprise two longitudinal surfaces 34, 36, one surface 34 located adjacent one opposed side, and the other surface 36 located adjacent the other opposed side. Longitudinal surfaces 34, 36 are adapted to aid in guarding against splashing of beverage dispensed from the stanchion 12 via tap 14. Surfaces 34, 36 may greatly aid in maintaining sanitary conditions in the establishment in which cover 10 is used.

Figure 3:
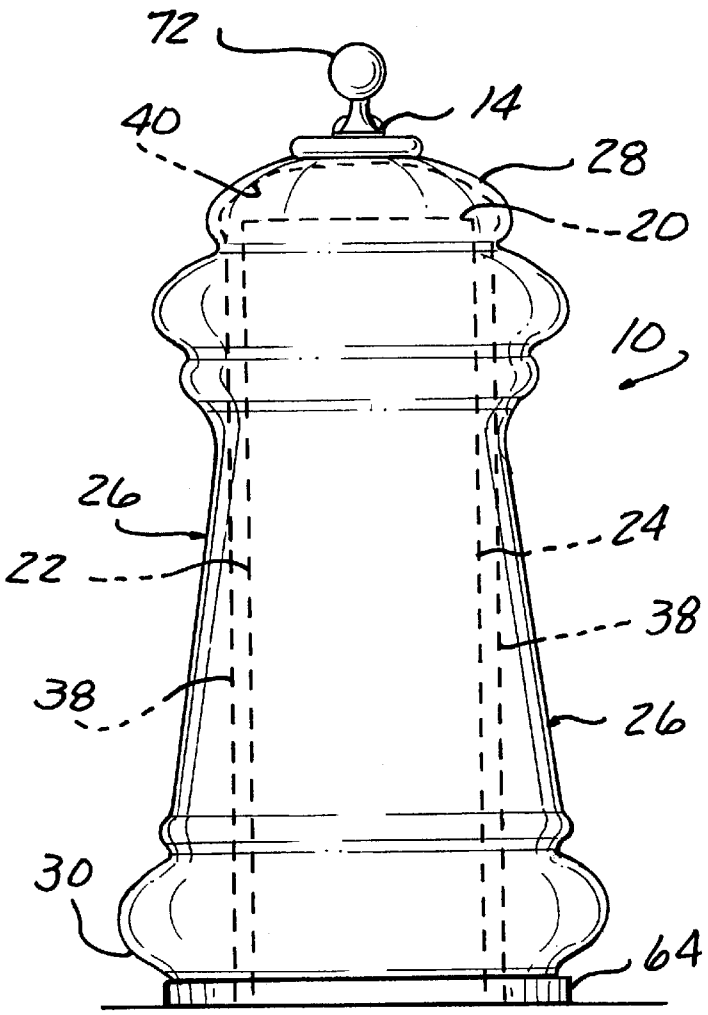
FIG. 3 is a back view of the present invention shown in place on a beverage dispenser stanchion.

Body 26 may further have an interior surface 38 adapted to be adjacent at least the stanchion back 18 (as can be seen in FIG. 3, surface 38 may also be adjacent stanchion side regions 22, 24). It is to be understood that interior surface 38 may be formed from one and/or a plurality of sections. However, in the preferred embodiment, it comprises one, continuous interior surface 38. The interior surface 38 may also be adapted to aid in guarding against splashing of beverage dispensed from stanchion 12. As such, surface 38 may also aid in maintaining sanitary conditions in the establishment in which cover 10 is used.

Cover 10 further comprises means adapted to quickly and removably mount the housing to the stanchion 12. In the preferred embodiment, the quick and removable mounting means comprises the body top region 28 comprising an interior hollow opening 40, the hollow opening 40 adapted to receive and enclose the stanchion upper region 20. With the upper region 20 within hollow opening 40, the cover 10 may be adequately assembled to stanchion 12.

However, for a more secure assembly, the quick and removable mounting means may further and/or alternately comprise a bracket 42 extending transversely over the longitudinal opening 32 and adapted to further extend about the stanchion front 16 extending outwardly from the longitudinal opening 32. Means are provided for attaching the bracket 42 to the body 26. It is to be understood that the attaching means may comprise any suitable means. However, in the preferred embodiment, body 26 has two threaded bores 44, 46, one bore defined in each of the longitudinal surfaces 34, 36. Throughbores 48, 50 are defined in each of the bracket ends 52, 54. A threaded fastening member is receivable through each of the bracket throughbores 48, 50 and threadingly engageable into each of the threaded body bores 44, 46. It is to be understood that the fastening member may comprise any suitable fastening device conventionally known in the art; however, in the preferred embodiment, the fastening member comprises screws 56, 58.

In order to create a more effective seal, and aid in preventing untoward vibration of cover 10 against stanchion 12, it may be desirable to install an appropriate sealing member 66 between bracket 42 and stanchion 12. Sealing member 66 may simply be placed between bracket 42 and stanchion 12 and frictionally engaged therebetween. Alternately, sealing member 66 may comprise two apertures 68, 70 through which screws 56, 58 may appropriately extend. It is to be understood that sealing member 66 may be formed in any suitable thickness and from any suitable material, including but not limited to any natural or synthetic rubber material, any suitable sealing and/or cushioning polymeric material, and the like.

As shown in FIG. 1, cover 10 may further comprise a stand off 60 attached to the body bottom 30. The stand off 60 may be attached by any suitable means, however, in the preferred embodiment, stand off 60 is tightly and frictionally engaged over an inwardly offset flange 62 defined at the terminal end of bottom 30. Stand off 60 is adapted to raise the cover 10 a predetermined distance, as desired. This advantageously allows a single cover 10 to fit various stanchions/towers 12 of different heights. It is to be understood that stand off 60 may be formed from any suitably rigid material. However, in the preferred embodiment, stand off 60 is formed from a metal material.

Figure 2:
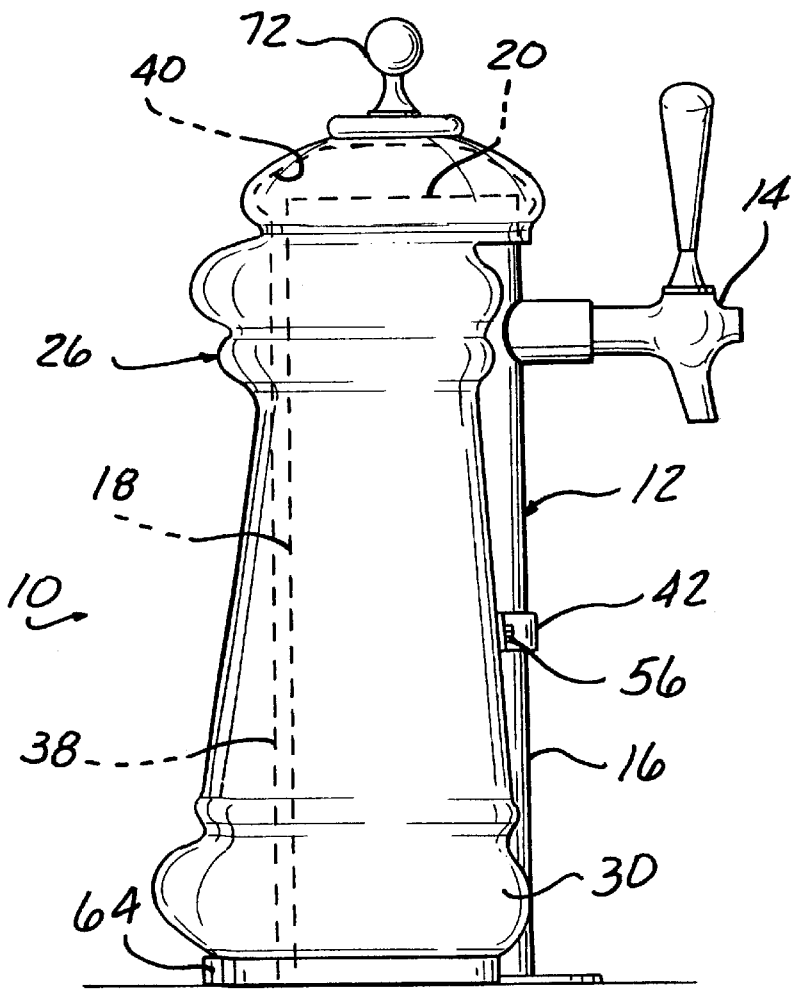
FIG. 2 is a side view showing the stanchion cover assembled to the stanchion.

As shown alternately in FIGS. 2–4, a decorative member 64 which does not adjust the height of cover 10 may be attached to the body bottom 30. As with stand off 60, member 64 may be attached by any suitable means, however, in the preferred embodiment, member 64 is tightly and frictionally engaged over inwardly offset flange 62 defined at the terminal end of bottom 30.

A handle 72 may be provided on cover 10, if desired. Handle 72 may be purely decorative if desired, or it may provide a means of lifting and/or transporting cover 10, as needed. It is to be understood that handle 72 may be attached to cover 10 by any suitable means. However, in the preferred embodiment, handle 72 is attached via threaded screw 74 which is threadingly engaged within threaded bore 76 defined in an upper end of top region 28 of body 26. A suitable nut (not shown) is then operatively and threadingly engaged on the end of screw 74 which extends into interior hollow opening 40.

Referring now to FIG. 4, there is shown a front view of the cover 10 of the present invention, shown in place on a dual-tap beverage dispenser stanchion. It is to be understood that cover 10 may be suited to fit a variety of stanchions of various shapes, sizes and tap configuration(s).

Stanchion cover 10 is a fast, simple and inexpensive way to cover various stanchions 12, such as for draft beer or other beverages, with various decorative covers 10, as desired. In use, the bartender/wait staff would see the front of cover 10, as in FIG. 4; whereas the customer would see the back of cover 10, as in FIG. 3. Suitable decorative indicia and/or advertising logos, or the like may be displayed on the back of cover 10, thus in a location highly visible to the customer.

In order to assemble cover 10 to stanchion 12, the cover 10 is placed on top of stanchion 12 so as to enclose upper region 20 of stanchion 12 within interior hollow opening 40 of body 26. If desired, the bracket 42 (and optional sealing member 66, if desired) is then attached to body 26 around stanchion front 16, as described hereinabove. If beverage is splashed onto stanchion front 16, body surfaces 34, 36 and/or any other surface of cover 10, these surface(s) may simply be rinsed off and/or otherwise easily cleaned. To clean the interior surface 38 of body 26, it may be desirable to remove bracket 42 and rotate cover 10 back to quickly clean surface 38 and side regions 22, 24 of stanchion 12. To remove for whatever reason, and/or for a more thorough cleaning of interior surface 38, as well as back 18, upper region 20 and side regions 22, 24 of stanchion 12, it may be desirable to completely remove cover 10. As is readily apparent, this may be accomplished by following the above-mentioned assembly steps in reverse order.

While preferred embodiments, forms and arrangements of parts of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A cover for a beverage dispenser stanchion having a front containing a tap and a back substantially distal to the tap, the cover comprising:

a housing shaped and adapted to contain at least the stanchion back, the housing comprising:

a body having a top region, a bottom and a longitudinal opening extending substantially from the body top region to the body bottom, the opening adapted to receive the stanchion, and adapted to have at least the stanchion front extending outwardly therefrom, the opening further adapted to have the tap extending outwardly and operatively therefrom; and means adapted to quickly and removably mount the housing to the stanchion, wherein the quick and removable mounting means comprises:

a bracket extending transversely over the longitudinal opening and adapted to further extend about the stanchion front extending outwardly from the longitudinal opening; and means for attaching the bracket to the body.

2. The stanchion cover as defined in claim 1 wherein the body is an integrally formed, one-piece member.

3. The stanchion cover as defined in claim 1 wherein the opening has two opposed sides, and wherein the body further comprises two longitudinal surfaces, one surface located adjacent one opposed side, and the other surface located adjacent the other opposed side, the longitudinal surfaces adapted to aid in guarding against splashing of beverage dispensed from the stanchion.

4. The stanchion cover as defined in claim 1 wherein the body has an interior surface adapted to be adjacent at least the stanchion back, the interior surface adapted to aid in guarding against splashing of beverage dispensed from the stanchion.

5. The stanchion cover as defined in claim 1, further comprising a stand off attached to the body bottom, the stand off adapted to raise the cover a predetermined distance.

6. The stanchion cover as defined in claim 5 wherein the stand off is removably attached to the body bottom.

7. The stanchion cover as defined in claim 1 wherein the longitudinal opening has two opposed sides, wherein the body further comprises two longitudinal surfaces, one surface located adjacent one opposed side, and the other surface located adjacent the other opposed side, and wherein the body has two threaded bores, one bore defined in one of the longitudinal surfaces, and the other bore defined in the other of the longitudinal surfaces, wherein the bracket has two ends, and wherein the attaching means comprises:

a throughbore defined in each of the bracket ends; and a threaded fastening member receivable through each of the bracket throughbores and threadingly engageable into each of the threaded body bores.

8. The stanchion cover as defined in claim 1 wherein the stanchion has two opposed side regions, and wherein the housing is shaped and adapted to contain the stanchion back and two opposed side regions.

9. A cover for a beverage dispenser stanchion having a front containing a tap, an upper region above the tap, and a back substantially distal to the tap, the cover comprising:

a housing shaped and adapted to contain at least the stanchion back, the housing comprising:

a body having a top region, a bottom and a longitudinal opening extending substantially from the body top region to the body bottom, the opening adapted to receive the stanchion, and adapted to have at least the stanchion front extending outwardly therefrom, the opening further adapted to have the tap extending outwardly and operatively therefrom; and means adapted to quickly and removably mount the housing to the stanchion, wherein the quick and removable mounting means comprises the body top region comprising an interior hollow opening, the hollow opening adapted to receive and enclose the stanchion upper region, and wherein the quick and removable mounting means further comprises:

a bracket extending transversely over the longitudinal opening and adapted to further extend about the stanchion front extending outwardly from the longitudinal opening; and means for attaching the bracket to the body.

10. The stanchion cover as defined in claim 8 wherein the longitudinal opening has two opposed sides, wherein the body further comprises two longitudinal surfaces, one surface located adjacent one opposed side, and the other surface located adjacent the other opposed side, and wherein the body has two threaded bores, one bore defined in one of the longitudinal surfaces, and the other bore defined in the other of the longitudinal surfaces, wherein the bracket has two ends, and wherein the attaching means comprises:

a throughbore defined in each of the bracket ends; and a threaded fastening member receivable through each of the bracket throughbores and threadingly engageable into each of the threaded body bores.

11. A cover for a beverage dispenser stanchion having a front containing a tap, an upper region above the tap, two opposed side regions, and a back substantially distal to the tap, the cover comprising:

a housing shaped and adapted to contain the stanchion back and two opposed side regions, the housing comprising:

a body having a top region, a bottom and a longitudinal opening extending substantially from the body top region to the body bottom, the opening having two opposed sides and adapted to receive the stanchion, and adapted to have at least the stanchion front extending outwardly therefrom, the opening further adapted to have the tap extending outwardly and operatively therefrom; and two longitudinal surfaces, one surface located adjacent one opposed side, and the other surface located adjacent the other opposed side, the longitudinal surfaces adapted to aid in guarding against splashing of beverage dispensed from the stanchion; and means adapted to quickly and removably mount the housing to the stanchion, wherein the quick and removable mounting means comprises the body top region comprising an interior hollow opening, the hollow opening adapted to receive and enclose the stanchion upper region, and wherein the quick and removable mounting means further comprises:

a bracket extending transversely over the longitudinal opening and adapted to further extend about the stanchion front extending outwardly from the longitudinal opening; and means for attaching the bracket to the body.

12. The stanchion cover as defined in claim 11 wherein the body has two threaded bores, one bore defined in one of the longitudinal surfaces, and the other bore defined in the other of the longitudinal surfaces, wherein the bracket has two ends, and wherein the attaching means comprises:

a throughbore defined in each of the bracket ends; and a threaded fastening member receivable through each of the bracket throughbores and threadingly engageable into each of the body bores.

13. The stanchion cover as defined in claim 12, further comprising a stand off attached to the body bottom, the stand off adapted to raise the cover a predetermined distance.

14. The stanchion cover as defined in claim 13 wherein the stand off is removably attached to the body bottom.

15. The stanchion cover as defined in claim 14 wherein the body is an integrally formed, one-piece member.

16. The stanchion cover as defined in claim 15 wherein the body has a continuous interior surface adapted to be adjacent the stanchion back and two opposed side regions, the interior surface adapted to aid in guarding against splashing of beverage dispensed from the stanchion.

* * * * *